US006663341B2

(12) United States Patent
Evans et al.

(10) Patent No.: US 6,663,341 B2
(45) Date of Patent: Dec. 16, 2003

(54) PROCESS FLUID RECYCLE SYSTEM FOR A COMPRESSOR ASSEMBLY

(75) Inventors: Alfred Peter Evans, East Amherst, NY (US); Neno Todorov Nenov, Williamsville, NY (US); Gregory William Henzler, East Amherst, NY (US); Jeffert John Nowobilski, Orchard Park, NY (US); Robert Leroy Baker, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 142 days.

(21) Appl. No.: 10/076,411

(22) Filed: Feb. 19, 2002

(65) Prior Publication Data

US 2003/0156939 A1 Aug. 21, 2003

(51) Int. Cl.[7] ..... F04D 29/00

(52) U.S. Cl. ..... 415/26; 415/169.2; 184/6.1; 210/DIG. 5

(58) Field of Search ..... 415/26, 169.2, 415/112, 121.2; 184/6.1, 6.21, 6.24, 6.4; 210/DIG. 5

(56) References Cited

U.S. PATENT DOCUMENTS

| | | | | |
|---|---|---|---|---|
| 3,753,043 A | * | 8/1973 | Plouffe | 317/13 A |
| 3,873,239 A | * | 3/1975 | Jamieson | 417/281 |
| 4,213,307 A | | 7/1980 | Watson | 62/192 |
| 5,347,821 A | * | 9/1994 | Oltman et al. | 62/84 |
| 6,018,962 A | | 2/2000 | Dewhirst et al. | 62/468 |
| 6,170,277 B1 | * | 1/2001 | Porter et al. | 62/228.3 |

* cited by examiner

*Primary Examiner*—Edward K. Look
*Assistant Examiner*—James M. McAleenan
(74) *Attorney, Agent, or Firm*—David M. Rosenblum

(57) ABSTRACT

A process fluid recycle system for compressor assemblies to recycle process fluid vapor flowing from one or more compressors to gear case(s) through shaft seal(s). The flowing process fluid is recycled back to the low pressure inlet of the compressor assembly by way of a recycle conduit. Coalescing filters are provided to separate oil mist from the process fluid vapor. Oil vapor and water vapor can also be removed, where necessary, by suitable oil and water vapor traps. During startup and shutdown or other times when low pressure transients occur that could cause a back flow of gear oil from the gear case into the compressor(s) by way of the shaft seal(s), an anti-back flow compressor is operated to ensure that the pressure within the gear case will be less than within the compressor.

13 Claims, 5 Drawing Sheets

PROCESS FLUID RECYCLE SYSTEM FOR A COMPRESSOR ASSEMBLY

FIELD OF THE INVENTION

The present invention relates to a process fluid recycle system for a compressor assembly having at least a compressor driven from a gear case to recycle process fluid flowing through a shaft seal, from the compressor to the gear case. More particularly, the present invention relates to such a process fluid recycle system in which an anti-back flow compressor is employed to prevent gear oil contained in the gear case from entering the compressor through the shaft seal.

BACKGROUND OF THE INVENTION

Prior art compressor assemblies employ one or more stages of compression, formed for instance, by a centrifugal compressor driven from an adjacent gear case by a shaft extending through a shaft seal between the stage of compression and the gear case. The shaft seal can be a labyrinth seal that is designed to allow rotation of the shaft while at least inhibiting loss of a process fluid being compressed by the compressor.

The shaft seal itself can be designed to accept a certain flow of the process fluid and therefore, a loss from the compressor. This is done to have a non-contact zero wear gas seal. As a result the gear oil within the gear case will not back flow through the shaft seal, in a direction from the gear case to the stage of compression, and thereby contaminate the process fluid.

As may be appreciated, the flow of process fluid into the gear case must either be vented or recycled back to the stage or stages of compression. When a compressor assembly is used in a refrigeration system, there is no option but to recycle the process fluid in that certain refrigerants are either toxic or potentially destructive to the environment. The potential loss of refrigerant can also degrade the performance of the refrigeration system. For instance, the composition of refrigerants used in mixed gas refrigerant systems, will change due to loss through shaft seals and the like. A typical mixed gas refrigerant is made up of nitrogen, argon, carbon tetrafluoride, pentabromoethane and perfluoropropl methyl ether and such constituents will be lost in unequal amounts due to their different properties. Furthermore, such refrigerants are expensive and any loss of refrigerant is a significant cost penalty to the process.

The prior art provides many examples of compressor assemblies that recycle process fluid flow through the shaft seal back to a low pressure inlet side of the compressor. An example of this can be found in U.S. Pat. No. 6,018,962. In this patent, the compressor assembly is housed in an air tight enclosure. Refrigerant flowing into the gear case mixes with gear oil and a mixture of refrigerant and gear oil collects in the oil sump of the gear case. The mixture is drawn through a demister element to separate the gear oil from the mixture under suction provided by the low pressure side of the compressor. The suction further draws the refrigerant from the demister element back into the low pressure side of the compressor.

In U.S. Pat. No. 4,213,307 the gear case of the compressor assembly is vented to a coalescing filter. The coalescing filter separates the refrigerant from the gear oil. The gear oil, after separation from the refrigerant, is pumped back into a oil sump of the gear case by a jet pump. The refrigerant is drawn from the coalescing filter back to the low pressure side of the compressor. A separate oil pump is used to pump oil to bearings contained within the gear case and also to supply pressurized oil as a motive fluid to the jet pump.

A problem inherent in all of the prior art devices is that when low pressure transients are encountered or during time periods in which the compressor assembly is started or shut down, the pressure within the gear case can be higher than that of the compressor being driven from the gear case. Normally, during operation, the pressure within the compressor is higher than the pressure within the gear case. When such pressure reversal occurs, the gear oil can back flow, that is, be driven through the shaft seal, from the gear case to the compressor to contaminate the refrigerant or other process fluid being compressed.

Furthermore, the illustrative, prior art compressor assemblies, described above, are integrated systems that are not very applicable to large scale installations of compressors or assemblies in which the separate components of the compressor assembly, namely, the motor, gear case, and compressor, are provided with separate enclosures and the components are separately installed on site.

As will be discussed, the present invention provides a system for recycling process fluid flow through a shaft seal of a compressor assembly that is specifically designed to prevent back flow of the gear oil into a compressor. Moreover, any application of the system of the present invention inherently requires very little modification of the components making up the compressor assembly.

SUMMARY OF THE INVENTION

The present invention provides a process fluid recycle system for a compressor assembly. The compressor assembly has at least a compressor driven from a gear case. The system acts to recycle process fluid vapor flowing through a shaft seal, from the compressor to the gear case.

In accordance with the present invention, the process fluid recycle system includes at least one coalescing filter to separate oil mist made up of the gear oil from the process fluid vapor. A recycle conduit is connected, at one end, to a low pressure inlet of the compressor assembly. The other end of the recycle conduit is in flow communication with the at least one coalescing filter to return the process fluid vapor to the compressor assembly. Two alternate flow paths are provided to conduct the oil mist and the process fluid vapor from the compressor assembly to the at least one coalescing filter. One of the two alternate flow paths is formed by an anti-back flow compressor in flow communication with the gear case such that operation of the anti-back flow compressor reduces pressure within the gear case below the compressor. The other of the two alternate flow paths is formed by a conduit also in flow communication with the gear case. A valve is located in the conduit to prevent the flow of the oil mist and the process fluid to the gear case during operation of the anti-back flow compressor. A controller activates the anti-back flow compressor to ensure pressure within the gear case is less than that of the compressor, thereby to prevent gear oil from being driven from the gear case into the compressor through the shaft seal.

The compressor assembly can also be provided with an oil sump connected to the gear case such that the oil mist and process fluid vapor collects in a headspace region thereof. The two alternate flow paths are connected to the oil sump so as to receive the oil mist and the process fluid vapor from the headspace region thereof. An oil return pump is connected between the at least one coalescing filter and the oil sump to return the gear oil to the oil sump.

As can be appreciated from the above description, the use of the anti-back flow compressor prevents the back flow of gear oil through the shaft seal that might otherwise occur during start-up and shutdown and other low pressure transients. Moreover, since the recycle system of the present invention is applied to existing compressor assemblies the compressor assemblies do not have to be modified to take advantage of the present invention. In this regard, one or more coalescing filters can be applied to prevent any oil from being recycled back to the compressor because, unlike some prior art designs, the filter does not have to be incorporated into the compressor assembly itself.

The present invention is applicable to multistage compression assemblies and in one aspect recycles process fluids through replication of the process fluid recycle system, described above, for each compressor thereof. In such an assembly, a second compressor is connected in series with a first compressor such that process fluid is initially compressed in the first compressor and is further compressed in the second compressor. The compressor assembly has first and second low pressure inlets to the first and second recycle compressors and first and second gear cases associated therewith.

A recycle system in accordance with this aspect of the present invention has a recycle conduit that is a first recycle conduit connected to the low pressure inlet of the first compressor. A recycle conduit, constituting a second recycle conduit, is connected to a low pressure inlet of the second compressor. The at least one coalescing filter is at least one first coalescing filter in flow communication with the other end of the first recycle conduit. At least one second coalescing filter is in flow communication with the other end of the second recycle conduit. A first of two alternate flow paths in flow communication with the first gear case to conduct the oil mist and the process fluid vapor to the at least one first coalescing filter. A second of the two alternate flow paths is in flow communication with the second gear case to conduct the oil mist and the process fluid vapor to the at least one second coalescing filter. The controller activates each anti-back flow compressor of the first and second of the two alternative flow paths to ensure pressure within the first and second gear case is less than that of the first and second compressor, respectively.

The compressor assembly of a multi-stage unit can also have first and second oil sumps connected to the first and second gear cases such that the oil mist and process fluid vapor collects in first and second headspace regions thereof. The first and second of the two alternate flow paths are connected to the first and second oil sumps so as to receive the oil mist and the process fluid vapor from the first and second headspace regions, respectively. A first oil return pump is connected between the at least one first coalescing filter and the first oil sump to return the gear oil to the first oil sump. A second oil return pump is connected between the at least one second coalescing filter and the first oil sump to return the gear oil to the first oil sump.

The present invention in another aspect is applied to multi-stage compressor assemblies in a more simplified fashion by combining elements. For instance in a multi-stage compressor assembly, the process fluid enters the first compressor through the low pressure inlet thereof, which thus constitutes a system inlet for the compressor assembly. The one end of the recycle conduit is connected to the system inlet. A first of two alternate flow paths is in flow communication with the first gear case to conduct the oil mist and the process fluid vapor to the at least one coalescing filter. A second of the two alternate flow paths is in flow communication with the second gear case to also conduct the oil mist and the process fluid vapor to the at least one coalescing filter. The controller activates each anti-back flow compressor of the first and second two alternate flow paths to ensure pressure within the gear case is less than that of the first and second compressors.

The compressor assembly can be provided with first and second oil sumps connected to the first and second gear cases such that the oil mist and process fluid vapor collects in first and second headspace regions thereof. The first and second of the two alternate flow paths are connected to the first and second oil sumps so as to receive the oil mist and the process fluid vapor from the first and second headspace regions, respectively. An oil return pump is connected between the at least one coalescing filter and the first and second oil sump to return the gear oil to the first and second oil sump.

Alternatively, first and second phase separators are connected to the first and second gear cases to separate the oil mist and the process fluid vapor from the gear oil. The compressor assembly also has a common oil sump connected to the first and second phase separators to receive the gear oil therefrom. The first and second of the two alternate flow paths are connected to the first and second phase separators to receive the oil mist and the process fluid vapor therefrom. An oil return pump is connected between the at least one coalescing filter and the common oil sump to return the gear oil to the common oil sump.

In a yet further aspect of the present invention involving its application to multi-stage compressors, still further simplification is possible. In such aspect of the present invention, the one end of the recycle conduit is connected to the system inlet. The compressor assembly is provided with a common oil sump connected to the first and second gear cases such that the process fluid vapor and the oil mist collecting in a headspace region thereof. This allows the two alternate flow paths to be connected to the common oil sump so as to receive the process fluid vapor and the oil mist from the headspace region. An oil return pump is connected between the at least one coalescing filter and the common oil sump to return the gear oil to the first and second oil sumps.

In all aspects of the present invention, an oil vapor adsorption trap and a water vapor adsorption trap can be interposed between the at least one coalescing filter and the conduit or each of the at least one first and second coalescing filters and each of the first and second recycle conduits. Furthermore, the controller can be a pressure differential switch connected to the anti-back flow compressor. In aspects of the invention involving multi-stage compression, the controller can comprise two pressure differential switches each respectively connected to the anti-back flow compressor of the first and second two alternate flow paths. Two pressure differential switches are positioned to react to pressure differentials between the first gear case and the first compressor and the second gear case and the second compressor.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

In order to avoid repetitious explanations of the elements in the Figures, the same reference numbers are used for the same elements that appear in the various figures without modification. Furthermore, where two identical elements are present, a suffix "a" to the reference number is used to indicate the first of the elements and a suffix "b" is used to indicate the second of the elements.

DETAILED DESCRIPTION

Figure 1:
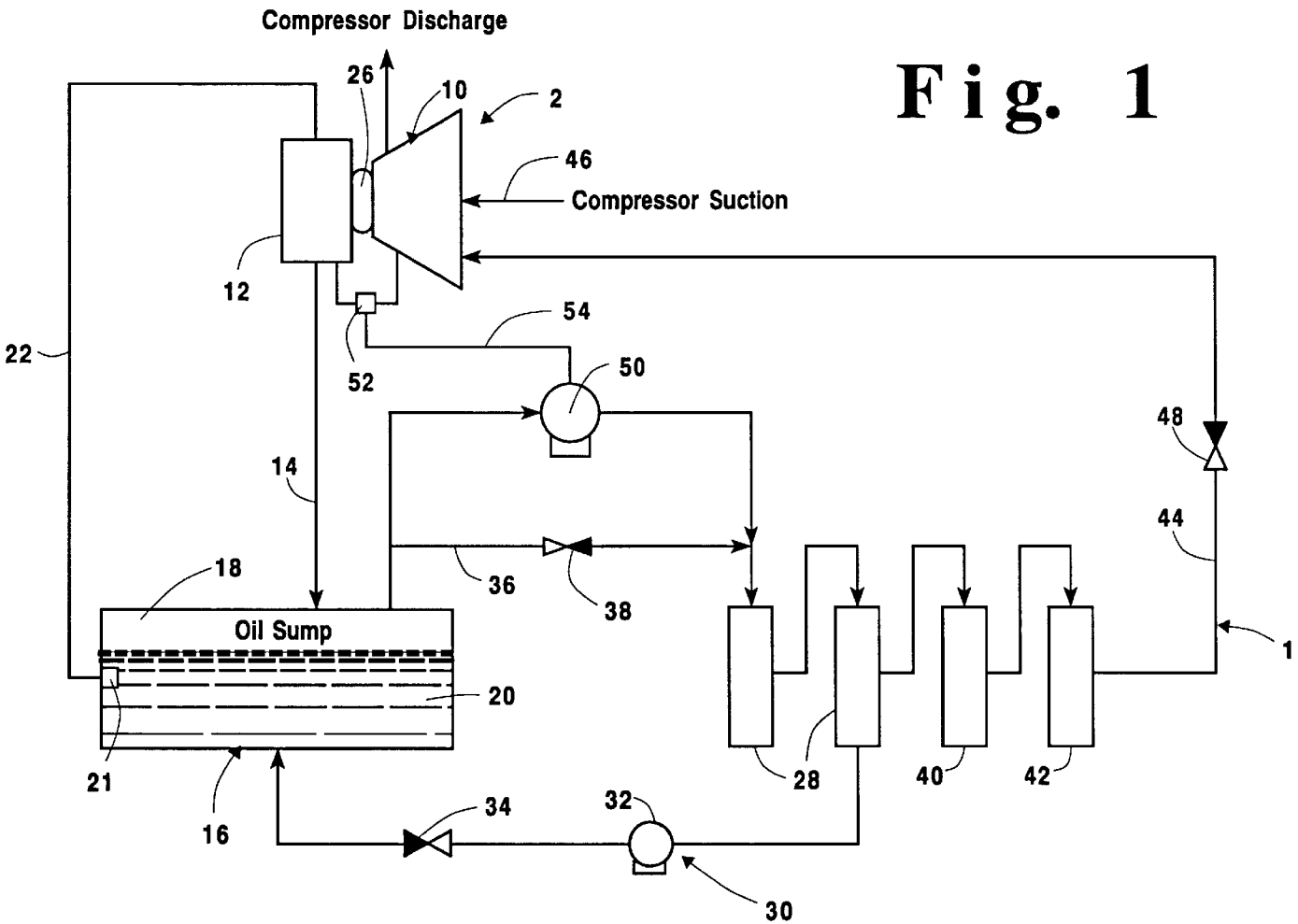
FIG. 1 is a schematic illustration of a process fluid recycle system in accordance with the present invention.

With reference to FIG. 1, a process fluid recycle system 1 is illustrated in connection with the recycle of process fluid being compressed by a compressor assembly 2. Compressor assembly 2 is provided with a single compressor 10 which can be a centrifugal compressor of the type having an impeller to compress a process fluid. In such a compressor, the impeller is driven by a shaft connected to gears located within a gear case 12. The gears are lubricated by gear oil. In case of a mixed gas refrigerant, a suitable gear oil is polyalphaolefin. The gears within gear case 12 and therefore, the impeller of compressor 10 are driven by an electric motor.

The gear oil drains via a conduit 14 into an oil sump 16. Oil sump 16 has a headspace region 18 situated above liquid gear oil 20. A submersible oil pump 21 pumps oil through a return path 22 back to gear case 12. Known features of return path 22 are not illustrated for purposes of simplicity. However, as would be known to those skilled in the art, return path 22 could include an oil cooler and filter. Gear oil could be returned to gear case 12 through an emergency oil reservoir. Additionally, suitable known controls are also not illustrated.

In compressor assembly 2, a shaft seal 26 is provided to seal the shaft that is used to drive compressor 10 from gear case 12. Shaft seal 26 acts to prevent gear oil from entering compressor 10 to contaminate the process fluid being compressed. Shaft seal 26, which can be a labyrinth seal, is continually self-purged with process fluid during normal operation. During such times, the compressor discharge pressure, which is greater than the gear case pressure, forces process fluid vapor to flow as a purge gas flow through the shaft seal 26. Thus, the process fluid, which can be a mixed gas refrigerant, is constantly being forced through shaft seal 26 into gear case 12.

During flow of gear oil through gear oil passage 14 to oil sump 16, the process fluid vapor will collect within headspace region 18 of oil sump 16 along with oil mist made up of the gear oil.

In accordance with the present invention, the process fluid vapor is recycled from headspace region 18 of oil sump 16 and recirculated back to compressor 10. Since, oil mist and process fluid vapor collects within headspace region 18, the oil mist must be separated from the process fluid vapor before the process fluid vapor is returned to compressor 10. This is accomplished by provision of one or more coalescing filters 28. Coalescing filters 28 can be obtained from Parker Company of 500 Glaspie St., Oxford, Mich. 48371 and Hankinson, Inc. of 1000 Philadelphia St., Canonsburg, Pa. 15317. It has been found that the concentration of oil within the process fluid leaving the last coalescing filter 28 will be in the part per billion range. The oil collects within the bottom of coalescing filters 28. It is preferable that the collected oil be directly reused. As such, an oil return circuit 30 is provided having an oil pump 32 to pump the collected oil back into oil sump 16. A check valve 34 is provided to prevent the back flow of oil 20 from oil sump 16. Coalescing filters 28 are in flow communication with gear case 12 through headspace region 18 of oil sump 16. There are two alternate flow paths for such flow communication. One of the two alternate flow paths is provided by a conduit 36 having preferably a check valve 38 to prevent the back flow of oil during operation of an anti-back flow compressor 50 (discussed hereinafter) that serves as the other of the two alternate flow paths. An oil vapor adsorption trap 40 can be connected to coalescing filters 28 to adsorb oil vapor. The adsorbent used may be carbon, molecular sieve or the like. A suitable oil vapor trap may be obtained from the Parker Company and Hankinson, Inc. It is to be noted that in come cases it may not be necessary to include oil vapor trap 40, dependent upon the vapor pressure of the gear oil. In systems in which water vapor may be present, a water vapor trap 42 can be provided to remove any water. Water vapor trap 42 can contain an adsorbent such as silica gel, molecular sieve, alumina or the like. Suitable water vapor traps can be obtained from Sporlan Valve Company of 206 Lange Dr., Washington, Mo. 63090 and Watsco Inc. of 2665 South Bayshore Dr., Coconut Grove, Fla. 33133.

As may be appreciated by those skilled in the art, in suitable applications of the present invention, oil vapor adsorption trap 40 and water vapor trap 42 could be deleted. Additionally, embodiments of the present invention are possible in which only a single coalescing filter 28 is employed or multiple coalescing filters 28 are used.

The process fluid after filtering is returned by a recycle conduit 44 connected at opposite ends to water vapor trap 42 and the low pressure inlet 46 of compressor 2. A surge check valve 48 is provided to prevent back flow of process fluid. It is to be noted that the process fluid after filtering is returned back to the low pressure inlet 46 of compressor 10 at a point that would be upstream of inlet vanes of the compressor. The suction pressure produced by compressor 10 is sufficiently low, compared to the pressure within gear case 12, to cause process fluid to flow from gear case 12, headspace region 18, coalescing filters 28, oil vapor adsorption trap 40 and water vapor adsorption trap 42.

During startup or shutdown of compressor assembly 2, the discharge pressure of compressor 10 is approximately the same as the suction pressure. Under these conditions, oil can back flow through shaft seal 26 into compressor 10. In order to assure that process fluid vapor always flows through shaft seal 26 and into gear case 12 without oil seeping in the opposite direction, the anti-back flow compressor 50 operates to lower the pressure within gear case 12 with respect to that of compressor 10. In such manner, the back flow of gear oil into the compressor 10 is prevented, thereby to prevent contamination of the process fluid being compressed by compressor 10.

Anti-back flow compressor 50 can be controlled by a known differential pressure switch 52. Differential pressure switch 52 is connected to anti-back flow compressor 50 by way of a conductor 54. The differential pressure switch is preferably set to trigger anti-back flow compressor 50 when the pressure within gear case 12 approaches that within compressor 10. The differential pressure switch can preferably be set to maintain the pressure within gear case 12 is 5–15 psig below compressor 10. Suction is thereby applied to gear case 12 to draw the process fluid vapor and oil mist from headspace region 18 and gear case 12 to the coalescing filter of filters 28. This will normally happen during startup and shutdown. Additionally, other low pressure transient conditions are possible in which anti-back flow compressor will be triggered.

It is understood that other known pressure controllers could be employed that have greater control capability than differential pressure switch 52. They are less preferred, however, due to the costs involved in obtaining such controllers.

In the illustrated embodiment, oil sump 16 provides a phase separation space to allow the process fluid vapor and the oil mist to separate from the liquid gear oil. As will be discussed below, other embodiments are possible in which separate phase separators are employed for such purposes. Although not illustrated, appropriately sized gear cases 12 could also be employed to provide a phase separation space to additionally perform phase separation between the gear oil liquid and the process vapor and gear oil mist. This is not preferred, however, in that such a possible embodiment might involve modification of a gear case 12 provided by a compressor manufacturer.

Figure 2:
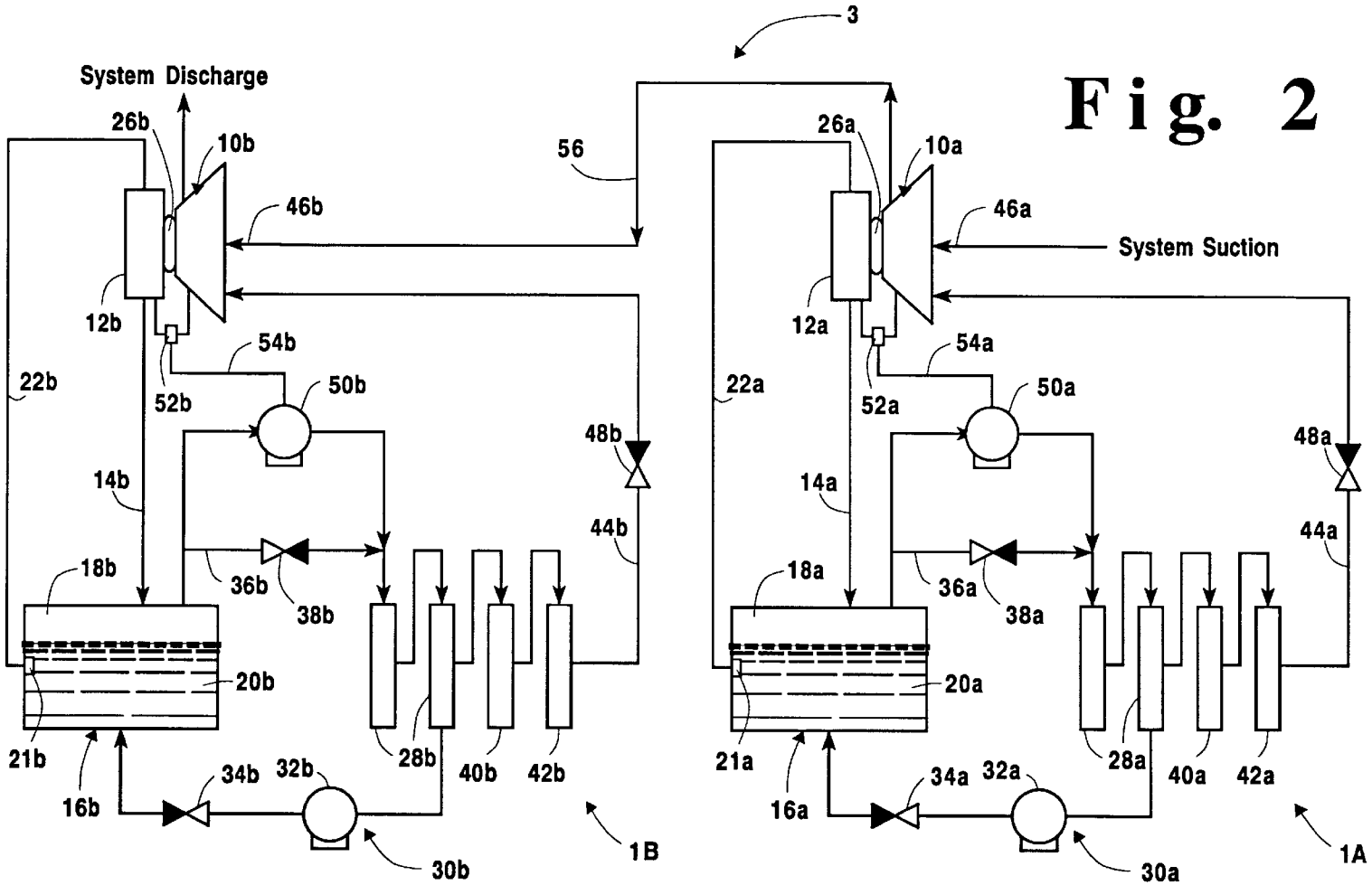
FIG. 2 is a schematic illustration of a process fluid recycle system in accordance with the present invention of the type shown in FIG. 1 that is applied to successive compressors of a compressor assembly.

With reference to FIG. 2, a compressor assembly 3 is illustrated having first and second compressors 10*a* and 10*b* connected in series by a conduit 56 such that the process fluid is initially compressed in first compressor 10*a* and then is further compressed in the second compressor 10*b*. Each of the compressors, 10*a* and 10*b*, is provided with a low pressure inlet, numbered 46*a* and 46*b*, respectively. Compressors 10*a* and 10*b* are driven by shafts connected to gears in a gear cases 12*a* and 12*b*. In this regard, the design of the compressors of compressors 10*a* and 10*b* might differ from one another, in a known manner, due to the respective pressure ranges of the compression required in each of the compressors 10*a* and 10*b*. Compressors 10*a* and 10*b* could, however, be identical.

During operation, process fluid vapor flows from each compressor 10*a* and 10*b* to its associated gear case 12*a* and 12*b*, respectively, through shaft seals 26*a* and 26*b* thereof and collects as a vapor. In order to recycle the process fluid, two process fluid recycle systems 1A and 1B, each having the same design and function as process fluid recycle system 1, are applied to first and second compressors 10*a* and 10*b*, respectively, as first and second sets of components. In this regard, a first of two alternate flow paths is formed by a conduit 36*a* having a check valve 38*a* and an anti-back flow compressor 50*a* and a second of two alternate flow paths is formed by a conduit 36*b* having a check valve 38*b* and an anti-back flow compressor 50*b*. The two alternate flow paths conduct the oil mist and process fluid vapor that collects in headspace regions 18*a* and 18*b* of oil sumps 16*a* and 16*b* to coalescing filters 28*a* and 28*b*, respectively. First and second oil return circuits 30*a* and 30*b* conduct the separated gear oil back to oil sumps 16*a* and 16*b*.

Figure 3:
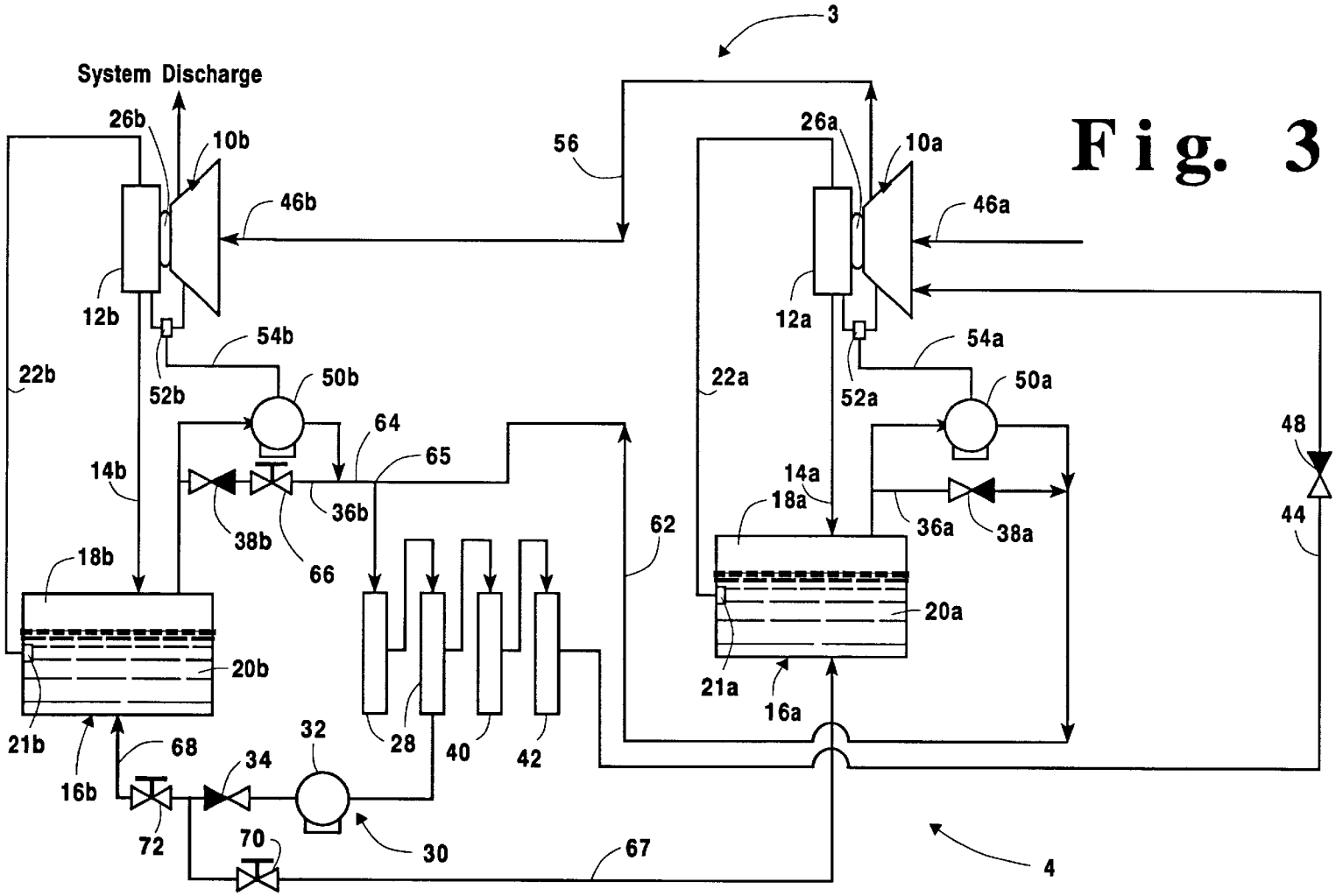
FIG. 3 is a schematic illustration of a process fluid recycle system in accordance with the present invention employed in connection with a compressor assembly having two compressors.

With reference to FIG. 3, a process fluid recycle system 4 is illustrated that is designed to be used in connection with a compressor assembly 3, described above in connection with the embodiment shown in FIG. 2. Process fluid recycle system 4 uses common components to avoid the entire duplication of a process fluid recycle system for each compressor in the manner shown in FIG. 2.

As illustrated, process fluid recycle system 4 utilizes a single recycle conduit 44 connected, at one end, to the low pressure inlet 46*a* associated with compressor 10*a* which constitutes the first compression stage. Low pressure inlet 46*a* functions as the system inlet to compressor assembly 3. A single set of one or more coalescing filters 28 connected in series and oil and water vapor adsorption traps 40 and 42 is connected to the other end of recycle conduit 44. Process fluid vapor and oil mist is separated from gear oil within phase separation spaces provided by oil sumps 16*a* and 16*b* and collects within headspace regions 18*a* and 18*b* thereof.

The separated oil mist and process fluid vapor is conducted to the a coalescing filter 28 that constitutes part of a single set of coalescing filters 28 and oil and water vapor adsorption traps 40 and 42 by a first and a second of two alternate flow paths (described above) by way of two conduits 62 and 64 that meet at a junction 65.

First and second anti-back flow compressors 50*a* and 50*b* are controlled by pressure differential switches 52*a* and 52*b* to prevent overpressures within gear cases 12*a* and 12*b* from building up and driving gear oil into compressors 10*a* and 10*b* in a manner described above. Since second compressor 10*b* operates at a higher pressure than first compressor 10*a*, the pressure within the gear case 12*b* associated with second compressor 10*b* will be higher than that of the gear case 12*a* associated with first compressor 10*a*. In order to equalize the pressure, pressure reduction is provided by such means as a throttle valve 66 located in conduit 36*b* to equalize pressure within conduit 36*b* to that of conduit 36*a*. It is to be noted that other means of throttling are possible, for instance, sizing various runs of piping differently to control the flow.

Additional efficiencies are realized by the use of a single oil return circuit 30 having a single pump 32 to pump gear oil recycled from coalescing filters 28 back to first and second oil sumps 16*a* and 16*b*. Thus two oil return conduits 67 and 68 are provided. In order to pump the oil to both first and second oil sumps 16*a* and 16*b*, an over pressure must be developed. Thus, throttle valve valves 70 and 72 are provided to reduce the pressure sufficiently to allow a gear oil to be returned to both first and second oil sumps 16*a* and 16*b* simultaneously.

Figure 4:
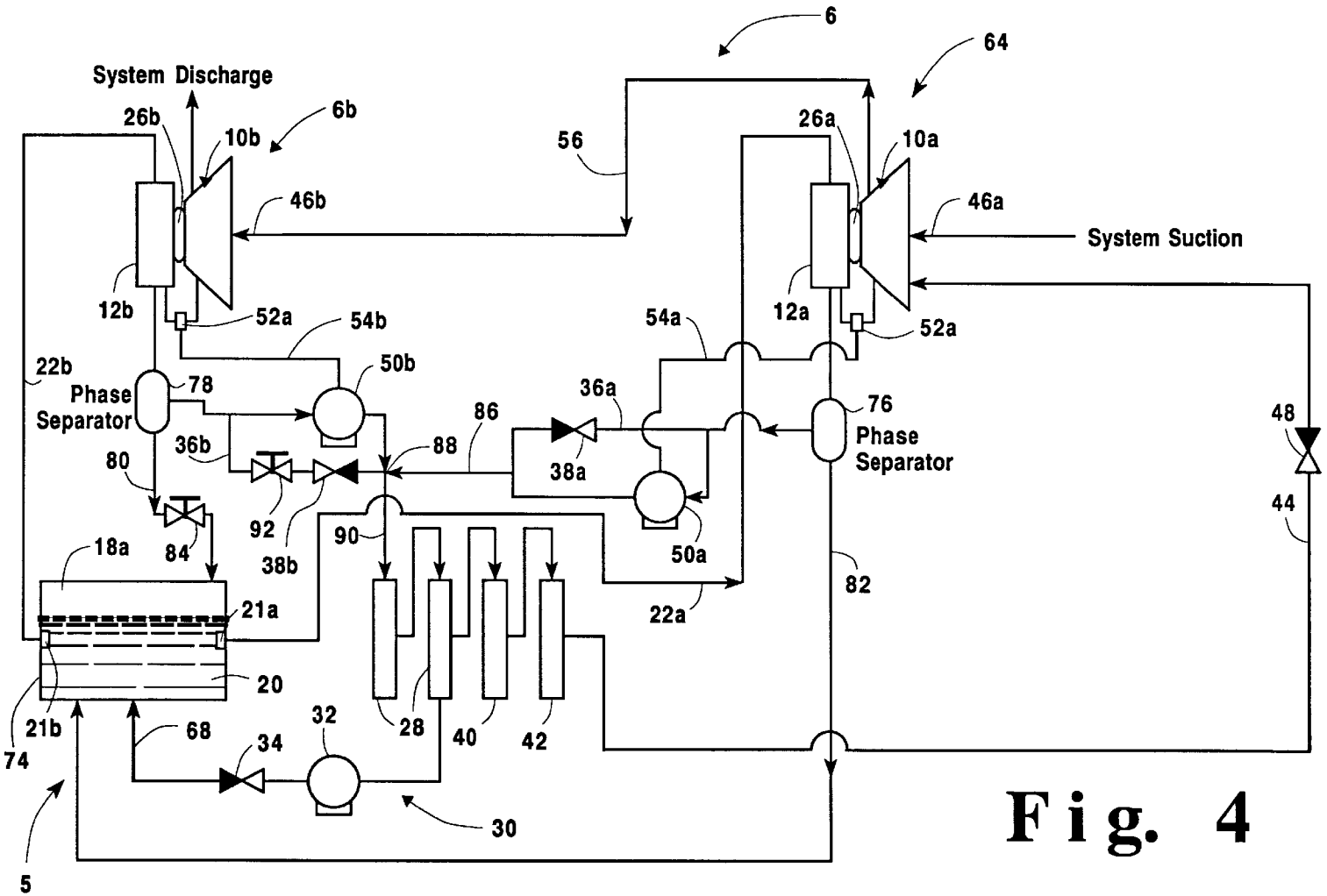
FIG. 4 is a schematic illustration of an alternative embodiment of the process fluid recycle system illustrated in FIG. 3.

With reference to FIG. 4, a process fluid recycle system 5 is provided that is designed to be used in connection with a two stage compressor assembly 6 having first and second compressors 10*a* and 10*b*. A further efficiency is realized in compressor assembly 6 by the use of a common oil sump 74 connected to gear cases 12*a* and 12*b* of first and second compressors 10*a* and 10*b*.

Oil mist and process fluid vapor to be recycled is separated from liquid gear oil by means of first and second phase separation spaces provided by first and second phase separators 76 and 78 interposed between gear cases 12*a* and 12*b* and the common oil sump 74. The separated liquid gear oil is introduced into common oil sump 74 by oil lines 80 and 82 leading from phase separators 76 and 78. A pressure control valve 84 is provided in oil line 80 to prevent higher pressures produced in second compressor 10*b* from driving oil from the common oil sump 74 back into first phase separator 76.

First and second of two alternate flow paths provide flow communication with gear cases 12*a* and 12*b* via connection of conduit 36*a* and anti-back flow compressor 50*a* to first phase separator 76 and connection of conduit 36*b* and anti-back flow compressor 50*b* to second phase separator 78. A single set of coalescing filters 28 and etc. is used as in the previous embodiment in which one or more coalescing filters 28 and oil and water vapor traps 40 and 42, if necessary, are connected in series and to both the first and second of the two alternate flow paths to separate oil mist, oil, and water from the process fluid vapor. The connection of such single set can be accomplished by way of a conduit 86 connected to first anti-back flow compressor 50*a* and first conduit 36*a* which meets second conduit 36*b* and second anti-back flow compressor 50*b* at a junction 88. A conduit 90 in turn communicates between junction 88 to the first in series of the coalescing 28. A throttle valve 92 is provided in second conduit 36*b* to prevent the high pressure produced within compressor 10*b* from driving oil mist and process fluid into conduit 88 by reducing the pressure within conduit 36*b*.

Figure 5:
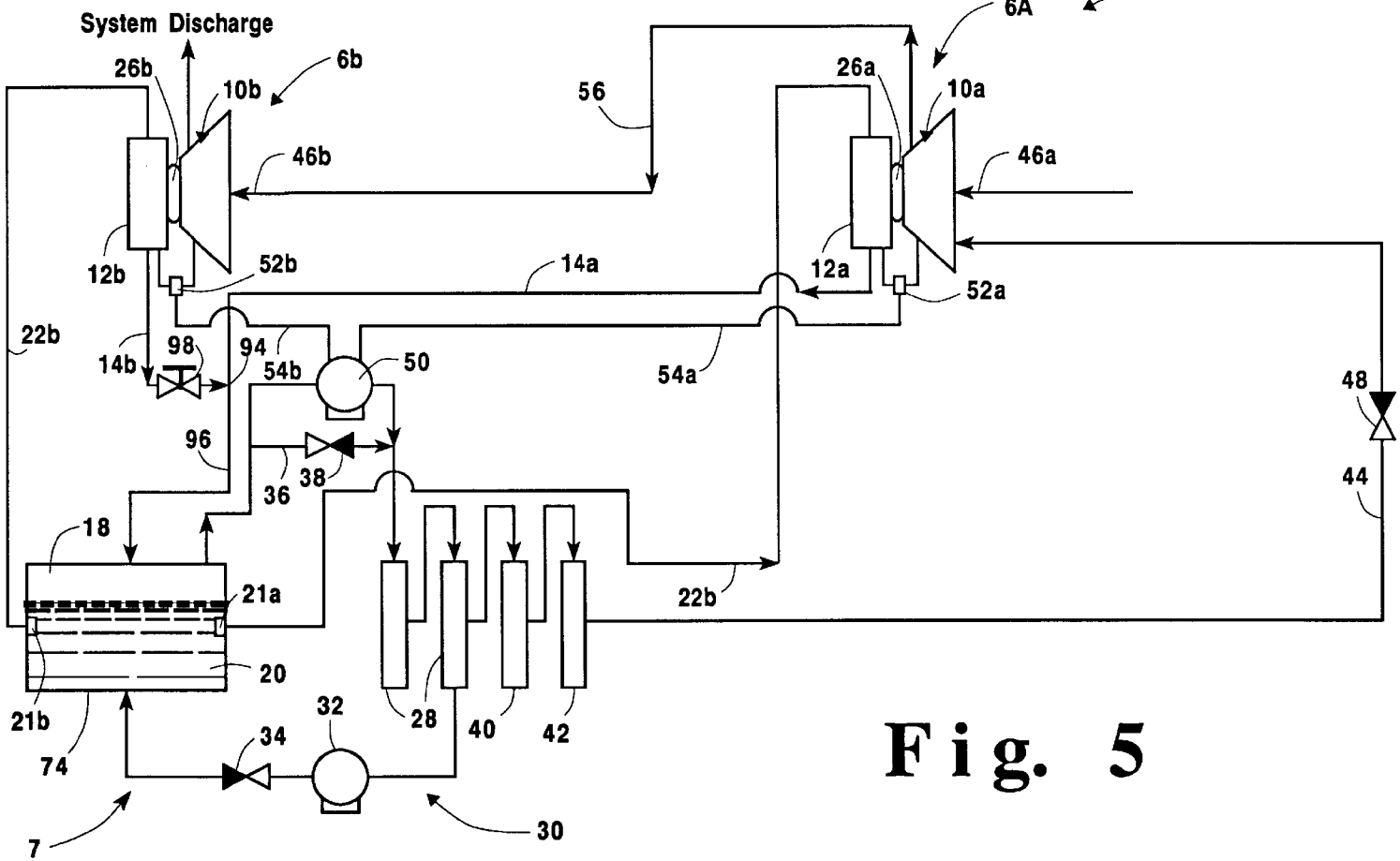
FIG. 5 is a schematic illustration of an alternative embodiment of the process fluid recycle system illustrated in FIG. 3.

With further reference to FIG. 5, a further simplified process fluid recycle system 7 is used in connection with compressor assembly 6 utilizing a common oil sump 74. Gear oil, oil mist, and process fluid vapor drain to common oil sump 74 through first and second conduits 14*a* and 14*b* which meet at a junction 94. A conduit 96 connects junction 94 to headspace region 18 of common oil sump 74. In order to prevent gear oil and etc. from being driven by the higher pressure of compressor 10*a* into second conduit 14*a* to gear case 12*a*, a throttle valve 98 is provided within conduit 14*a*. An alternative is to eliminate throttle valve 98 such that gear case 12*b* is maintained at the same pressure of gear case 12*a*.

The feature distinguishing this embodiment from the other embodiments having compressor assemblies employing multiple stages is the use of a single set of two alternate flow paths formed by an anti-back flow compressor 50 and a conduit 36.

Common oil sump 74 provides a phase separation space to separate oil mist and process fluid vapor from gear oil liquid. The use of common oil sump 74 also allows anti-back flow compressor 50 to lower pressure within both gear cases 12*a* and 12*b* and thereby ensure the proper pressure differential is maintained between gear cases 12*a* and 12*b* and the respective compressors 10*a* and 10*b*.

Anti-back flow compressor 50 is controlled by pressure differential switches 52*a* and 52*b* triggered by a pressure differential existing either between compressor 10*a* and gear case 12*a* or compressor 10*b* and gear case 12*b* that would drive gear oil through shaft seals 26*a* and 26*b* into compressors 10*a* and 10*b*.

While the present invention has been described with reference to preferred embodiment, as will occur to those skilled in the art, numerous changes, additions and omissions may be made without departing from the spirit and the scope of the present invention.

We claim:

1. A process fluid recycle system for a compressor assembly having at least a compressor driven from a gear case to recycle process fluid vapor flowing through a shaft seal, from the compressor to the gear case, said process fluid recycle system including:

at least one coalescing filter to separate oil mist made up of said gear oil from the process fluid vapor;

a recycle conduit, at one end, connected to a low pressure inlet of said compressor assembly and, at the other end, in flow communication with said at least one coalescing filter to return said process fluid vapor to said compressor assembly;

two alternate flow paths to conduct said oil mist and said process fluid vapor from said compressor assembly to said at least one coalescing filter, one of the two alternate flow paths formed by an anti-back flow compressor in flow communication with said gear case such that operation of said anti-back flow compressor reduces pressure within said gear case below said compressor and a conduit also in flow communication with said gear case and having a valve to prevent flow of said oil mist and said process fluid to said gear case during operation of said anti-back flow compressor; and a controller to activate said anti-back flow compressor to ensure pressure within the gear case is less than that of the compressor, thereby to prevent gear oil from being driven from the gear case into the compressor through the shaft seal.

2. The process fluid recycle system of claim 1, wherein:

said compressor comprises a first compressor;

a second compressor is connected in series with said first compressor such that process fluid is initially compressed in the first of the compressors and is further compressed in the second of the compressors;

the process fluid enters the first compressor through the low pressure inlet thereof that constitutes a system inlet for the compressor assembly;

said one end of said recycle conduit is connected to said system inlet;

the two alternate flow paths are a first of two alternate flow paths in flow communication with said first gear case to conduct said oil mist and said process fluid vapor to said at least one coalescing filter;

a second of the two alternate flow paths is in flow communication with said second gear case to also conduct said oil mist and said process fluid vapor to said at least one coalescing filter; and the controller activates each said anti-back flow compressor of said first and second two alternate flow paths to ensure pressure within the gear case is less than that of the first and second compressors.

3. The process fluid recycle system of claim 2, wherein:

said compressor assembly also has first and second oil sumps connected to said first and second gear cases such that said oil mist and process fluid vapor collects in first and second headspace regions thereof;

said first and second of the two alternate flow paths are connected to said first and second oil sumps so as to receive said oil mist and said process fluid vapor from said first and second headspace regions, respectively; and an oil return pump is connected between said at least one coalescing filter and said first and second oil sump to return said gear oil to said first and second oil sump.

4. The process fluid recycle system of claim 2, wherein:

first and second phase separators are connected to said first and second gear cases to separate said oil mist and said process fluid vapor from said gear oil;

said compressor assembly also has a common oil sump connected to said first and second phase separators to receive said gear oil therefrom;

said first and second of the two alternate flow paths are connected to said first and second phase separators to receive said oil mist and said process fluid vapor therefrom; and an oil return pump is connected between said at least one coalescing filter and said common oil sump to return said gear oil to said common oil sump.

5. The process fluid recycle system of claim 1, wherein:

said compressor assembly also has an oil sump connected to said gear case such that said oil mist and process fluid vapor collects in a headspace region thereof;

said two alternate flow paths is connected to said oil sump so as to receive said oil mist and said process fluid vapor from said headspace region thereof; and an oil return pump is connected between said at least one coalescing filter and said oil sump to return said gear oil to said oil sump.

6. The process fluid recycle system of claim 1, wherein:

said compressor comprises a first compressor;

a second compressor is connected in series with said first compressor such that process fluid is initially compressed in the first of the compressors and is further compressed in the second of the compressors;

the process fluid enters the first compressor through the low pressure inlet thereof that constitutes a system inlet for the compressor assembly;

said one end of said recycle conduit is connected to said system inlet;

said compressor assembly also has a common oil sump connected to said first and second gear cases such that said process fluid vapor and said oil mist collecting in a headspace region thereof;

the two alternate flow paths are connected to said common oil sump so as to receive said process fluid vapor and said oil mist from said headspace region; and an oil return pump is connected between said at least one coalescing filter and said common oil sump to return said gear oil to said first and second oil sumps.

7. The process fluid recycle system of claim 1 or claim 2 or claim 6, further comprising an oil vapor adsorption trap and a water vapor adsorption trap interposed between said at least one coalescing filter and said recycle conduit.

8. The process fluid recycle system of claim 7, wherein said controller comprises two pressure differential switches connected to said anti-back flow compressor, the two pressure differential switches positioned to react to pressure differentials between said first gear case and said first compressor and said second gear case and said second compressor.

9. The process fluid recycle system of claim 1, wherein said controller is a pressure differential switch connected to said anti-back flow compressor.

10. The process fluid recycle system of claim 1, wherein:

said compressor comprises a first compressor;

a second compressor is connected in series with said first compressor such that process fluid is initially compressed in the first compressor and is further compressed in the second of the compressors;

said low pressure inlet and said gear case are a first low pressure inlet and a first gear case, respectively;

said recycle conduit comprises a first recycle conduit connected to the low pressure inlet of the first compressor;

a second recycle conduit is connected to a second low pressure inlet of the second compressor;

the at least one coalescing filter is at least one first coalescing filter in flow communication with the other end of the first recycle conduit;

at least one second coalescing filter is in flow communication with the other end of said second recycle conduit;

the two alternate flow paths is a first of two alternate flow paths in flow communication with said first gear case to conduct said oil mist and said process fluid vapor to said at least one first coalescing filter;

a second of the two alternate flow paths is in flow communication with said second gear case to conduct said oil mist and said process fluid vapor to said at least one second coalescing filter; and the controller activates each said anti-back flow compressor of said first and second of the two alternative flow paths to ensure pressure within the first and second gear case is less than that of the first and second compressor, respectively.

11. The process fluid recycle system of claim 10, wherein:

said compressor assembly also has first and second oil sumps connected to said first and second gear cases such that said oil mist and process fluid vapor collects in first and second headspace regions thereof;

said first and second of the two alternate flow paths are connected to said first and second oil sumps so as to receive said oil mist and said process fluid vapor from said first and second headspace regions, respectively; and a first oil return pump is connected between said at least one first coalescing filter and said first oil sump to return said gear oil to said first oil sump; and a second oil return pump is connected between said at least one second coalescing filter and said first oil sump to return said gear oil to said first oil sump.

12. The process fluid recycle system of claim 10, further comprising a first oil vapor adsorption trap and a first water vapor adsorption trap interposed between said at least one first coalescing filter and said other end of said first recycle conduit and a second oil vapor adsorption trap and a second water vapor adsorption trap interposed between said at least one second coalescing filter and said other end of said second first recycle conduit.

13. The process fluid recycle system of claim 10 or claim 2, wherein said controller comprises two pressure differential switches each respectively connected to said anti-back flow compressor of said first and second two alternate flow paths, the two pressure differential switches positioned to react to pressure differentials between said first gear case and said first compressor and said second gear case and said second compressor.

* * * * *